US006725914B2

(12) United States Patent
Petterson

(10) Patent No.: US 6,725,914 B2
(45) Date of Patent: Apr. 27, 2004

(54) DOUBLE DUCT CHANGEOVER HVAC SYSTEM

(76) Inventor: Bart Petterson, 4577 Chinden, Boise, ID (US) 83714

( * ) Notice: Subject to any disclaimer, the term of this patent is extended or adjusted under 35 U.S.C. 154(b) by 284 days.

(21) Appl. No.: 10/012,769

(22) Filed: Nov. 5, 2001

(65) Prior Publication Data

US 2003/0085033 A1 May 8, 2003

(51) Int. Cl.[7] ..... F24F 3/044

(52) U.S. Cl. ..... 165/208; 165/211; 165/216; 165/217; 165/244; 236/49.3; 236/1 B; 236/1 C

(58) Field of Search ..... 165/208, 209, 165/211, 216, 217, 244; 236/49.3, 1 B, 1 C

(56) References Cited

U.S. PATENT DOCUMENTS

| | | | | |
|---|---|---|---|---|
| 3,945,432 A | | 3/1976 | Tamblyn | 165/22 |
| 4,071,082 A | | 1/1978 | Economides | 165/101 |
| 4,300,623 A | | 11/1981 | Meckler | 165/16 |
| 4,328,926 A | | 5/1982 | Hall, Jr. | 236/13 |
| 4,491,061 A | | 1/1985 | Nishizawa et al. | 98/34.6 |
| 4,530,395 A | | 7/1985 | Parker et al. | 165/16 |
| 4,549,601 A | | 10/1985 | Wellman et al. | 165/2 |
| 4,633,937 A | | 1/1987 | Zilbermann | 165/22 |
| 4,673,029 A | | 6/1987 | Beachboard | 165/22 |
| 4,890,666 A | * | 1/1990 | Clark | 165/208 |
| 4,931,948 A | | 6/1990 | Parker et al. | 364/505 |
| 5,161,608 A | | 11/1992 | Osheroff | 165/22 |
| 5,350,113 A | | 9/1994 | Coogan | 236/13 |
| 5,544,809 A | | 8/1996 | Keating et al. | 236/44 C |
| 5,573,181 A | | 11/1996 | Ahmed | 236/49.3 |
| 5,860,473 A | | 1/1999 | Seiden | 165/208 |
| 5,931,227 A | | 8/1999 | Graves | 165/216 |
| 5,944,098 A | | 8/1999 | Jackson | 165/217 |

* cited by examiner

*Primary Examiner*—John K. Ford
(74) *Attorney, Agent, or Firm*—Robert L. Shaver; Frank J. Dykas; Stephen M. Nipper

(57) ABSTRACT

The invention is a double duct changeover HVAC system, which uses two conditioned air sources to deliver air into two main duct systems. The two main duct systems are routed toward the exterior exposures of a building, and converge into a single duct which is routed to heating and cooling zones. Exterior exposure dampers control the mix of air so that the correct air temperature is sent to each exterior exposure. A damper at each heating and cooling zone controls the air flow into each heating and cooling zone, and VAV logic is used to deliver the correct air temperature and air flow to each heating and cooling zone of a building.

11 Claims, 4 Drawing Sheets

DOUBLE DUCT CHANGEOVER HVAC SYSTEM

BACKGROUND OF THE INVENTION

1. Field of the Invention

The present invention generally relates to HVAC (heating, ventilating and air conditioning) systems, and more particularly relates to systems and methods for delivering air to areas of a building by the use of a dual duct system which converts to a multiple zoned single duct system at the delivery end.

2. Background Information

There are a number of ways of heating rooms within a commercial building, but one method currently in use is the use of a double duct system. In a double duct system, one duct delivers cool air from a cool air source such as an air conditioning unit, and another duct delivers warm air from a heater. The two ducts are routed to each room or heating and cooling zone of a building. At the room or heating and cooling zone, the cool air and warm air are mixed according to the temperature needs of that specific room or zone. Thus, each room or zone has two ducts delivered into a mixing chamber, and it also has two dampers which open and close both ducts to deliver the right amount of hot and cold air to achieve the desired temperature of air for delivery to the room or zone. A computer can be utilized and a method called variable air volume (VAV) can be utilized so that each room gets the desired volume and temperature of air it requires, and the temperature of the cold air and the hot air is adjusted to best meet the needs of all of the rooms.

A disadvantage of a conventional dual duct system is that it is expensive to install, because two complete ducting systems must be delivered to each room or zone to be heated or cooled, and two computer controlled VAV dampers are required in each room or zone to be heated and cooled. If similar performance could be achieved while having only one duct routed to each room or zone, then significant savings could be achieved in the cost of ducting, dampers, mixing chambers and the labor involved in installation. Energy savings could be achieved in a system in which the conditioned air is generally not mixed from hot or cold air.

SUMMARY OF THE INVENTION

The invention is a double duct changeover HVAC system, which provides a simple, and effective means for economically controlling the temperature and air flow in buildings. The system utilizes two conditioned air sources. In one configuration of the system, one conditioned air source provides warm air, and the other conditioned air source provides cool air. Certain advantages are achieved if one or both of the conditioned air sources also have the ability to produce hot or cold air depending upon the demands of the heating and cooling zones. Air from the first and second conditioned air source is blown by a fan into a first and second main duct system. However, unlike the prior art, these two duct systems, which typically would contain air of different temperatures, are not ducted directly into each room or heating and cooling zone. In this description, it is to be understood that a room is a heating and cooling zone, but several rooms can also make up a single heating and cooling zone. When a "room" is referred to, what is meant is a heating and cooling zone.

In one configuration of the invention, a building or floor to be heated is divided into exterior exposures. This would typically be four exterior exposures, representing the four sides of the building, but more than four exterior exposures are also possible if certain areas of the building experienced unique sun or wind exposure. In general, all of the heating and cooling zones or rooms within a particular exterior exposure would be subjected to similar exposure to the sun, shade of the building, wind exposure and other exterior environmental factors. For instance, all of the heating and cooling zones on a north facing side of building would be in one exterior exposure, and they would generally be subjected to similar sun exposure and heat loss. Similarly, all the rooms or heating and cooling zones on the south side of a building could also be in the same exterior exposure. Those rooms would be expected to have similar exposure to sun and heat loss to each other, but could be quite different from the environmental conditions found on the north facing exterior exposure.

In the double duct changeover HVAC system of the invention, air from the first conditioned source and the second conditioned air source is available for each exterior exposure. This can be by ducting branches of the first and second main duct system extending toward each of the four exterior exposures of the typical installation. At some point, near the edge of a particular exterior exposure, the ducts of the first main duct system and the second main duct system would terminate in a Y or T connection and proceed from that point as a single duct. Air through this single duct would be distributed to each of the heating and cooling zones of that particular exterior exposure. Exterior exposure dampers are present in each terminus of the first main duct system and the second main duct system. The exterior exposure dampers variably open or close to regulate the air flowing from each of the first main duct system and the second main duct system, and to control the temperature of air delivered to each room.

However, the individual heating and cooling zones within the exterior exposure would also inevitably have different air flow quantity needs. Achieving the right temperature in any particular heating and cooling zone, when air of a uniform temperature is delivered to each of the exterior exposures, can be accomplished by the system of the invention.

Each of the heating and cooling zones have a sensor for determining the air flow into the room or heating and cooling zone, and the temperature of the room or heating and cooling zone. Based upon the heating and cooling needs of each room, a damper at each room would open or close to deliver the right volume of air to each room to achieve the desired temperature and airflow. The temperature of air to be delivered to each exterior exposure would be determined by a sampling of all of the temperature sensing devices from each of the rooms of the exterior exposure. A value would be arrived at by calculation in a computer, and the selected temperature of air would be mixed at the exterior exposure dampers of each exterior exposure. The volume of that air would be calculated by the computer, and each heating and cooling zone damper would variably open to admit the calculated volume of the air from the distribution duct system into each room.

It is possible that the heating and cooling needs of one particular room of an exterior exposure would have incompatible needs from the other rooms of that exposure. For instance, one room could need cool air, while the other eight rooms needed hot air. In such a circumstance, the computer would sample all of the temperature sensing sites and determine the needs for all of the sites. When an incompatibility is detected, the computer calculates a split delivery schedule of air to rooms with conflicting needs. For instance, for a period of time, the exterior exposure dampers of one exterior exposure would mix air so that heated air goes to the eight rooms which need heated air. During that time, the zone damper in the room which needed cool air would close or go to a minimum setting, and a minimum or none of the warm air would be delivered to that room. After a period of time, the computer would change the mix of hot and cold air at the exterior exposure dampers for the exterior exposure, and send cool air into the distribution duct system for that exterior exposure. At the same time, the heating and cooling zone dampers for the rooms which needed warm air would close or go to a minimum setting, the zone damper for the rooms needing cold air would open, and the cool air would only go to the room which needed cool air. If several rooms needed cool air, each of their heating and cooling zone dampers would adjust to deliver the right amount of cool air to each one to achieve the proper temperature. After a period of time, the heating and cooling zone dampers in the rooms which require cooling would shut or go to a minimum setting, the exterior exposure damper would change the mix to hot air instead of cool air, and the heating and cooling zone dampers of the rooms requiring heated air would variably open to allow the calculated amount of heated air to enter each of those rooms.

This same technique of mixing temperatures could be made even more flexible by the use of a first conditioned air source and a second conditioned air source which can deliver either hot or cold air. Thus, in some circumstances, both of the first main duct system and the second main duct system would contain hot air, and at other times, possibly during the same day and on the same floor and on the same exterior exposure, both the first main duct system and the second main duct system could contain cold air, and deliver this cold air directly to certain rooms but not others.

This system relies on computing ability and the climate control logic to select an air temperature for an exterior heating zone, and to further select an air temperature and air flow from the distribution duct system to flow into each room of the exterior exposure. The system has the advantage of eliminating some of the disadvantages of dual duct HVAC systems, and systems in which heating and cooling capabilities are delivered to each exterior exposure. In the installation of the HVAC system of the invention, when compared with other building heating systems, there is no hot water piping, no chilled water piping, no fan powered terminal VAV boxes, no compressors, and no water valves, pumps or filters in the conditioned space. This system also has the advantage of providing temporary heat availability early in the construction process. This is due to the simple systems inside the occupied space. The system can provide heating, cooling and ventilation air efficiently to any room, zone or small group of similar zones.

Typical installation of the invention would utilize roof mounted heating and cooling systems, but these could also be installed in equipment rooms. A large roof mounted system could supply the heating and cooling needs of many floors and all of the interior and exterior exposures of each floor. If the system were arranged to have a first conditioned air source and a second conditioned air source on each floor, it would work in the same way, with air temperature being selected by voting of the heating and cooling zones, and delivery of air being selected by the heating and cooling zone damper of each individual heating and cooling zone.

A typical building floor plan would have a large interior area in addition to the four perimeter exterior exposures. The cool air for the interior area would typically be fed from the cool air producing conditioned air source. Heating of the interior area would typically not be required, because the interior area would be completely surrounded by heated exterior exposures, which were losing heat to the outside of the building. In certain situations, a particular building or floor may be found to need heated air delivery in the interior area. In that case, heating and cooling zone dampers would be provided for both hot and cold air in the interior zone. The heated and cooled air would come off of the first main duct system and the second main duct system which would typically contain cold and hot air, respectively.

In one configuration of the invention, when it is hot outside, either one or both the first and second conditioned air source become peak cooling units, and cold air is directed into the first and second main duct system. A further optional feature of the HVAC system of the invention is the option of using cold air, below 55° F., in one or both of the first and or second conditioned air sources. Utilizing air of this temperature allows ducts to be smaller than would otherwise be possible.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
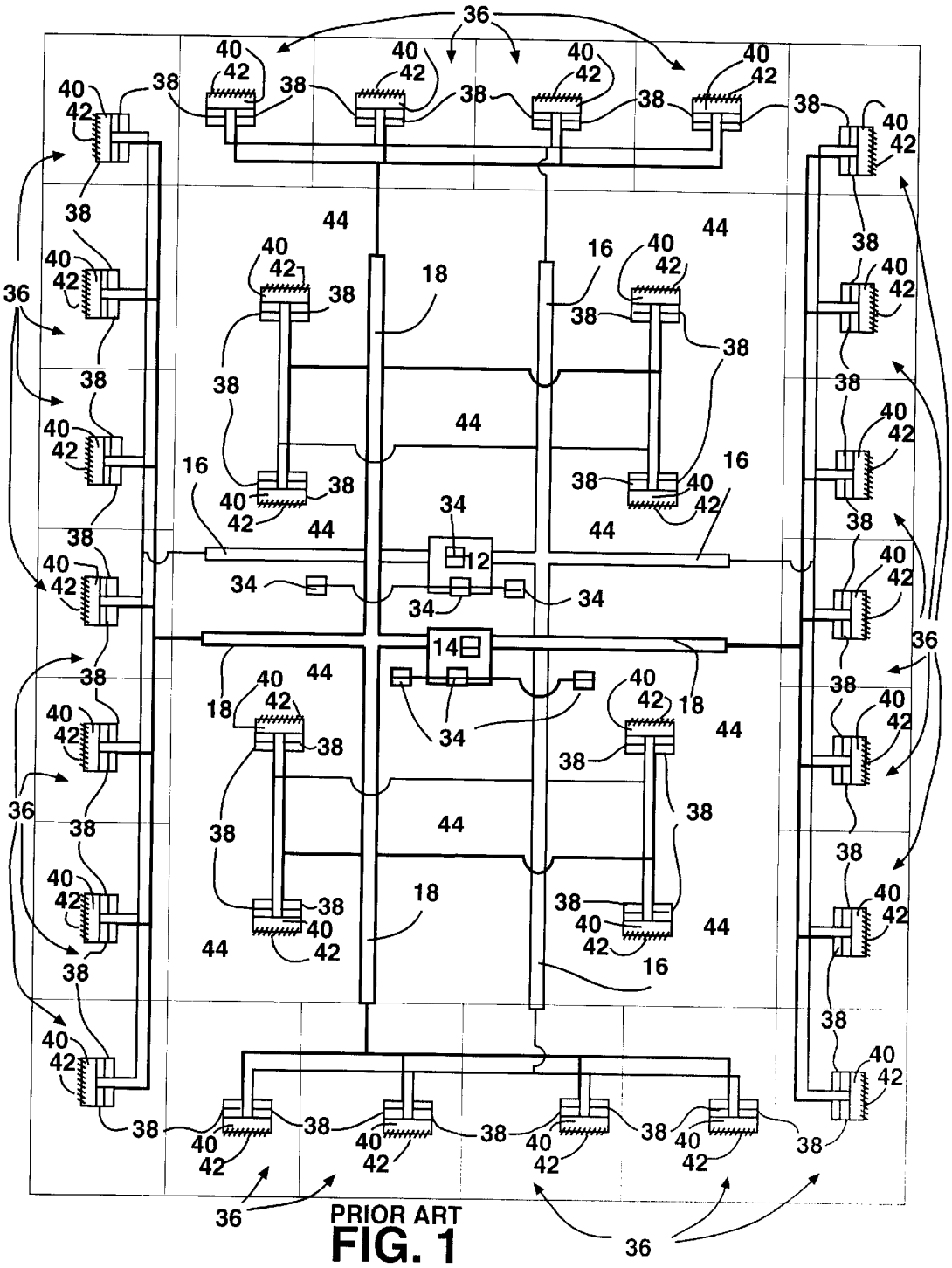
PRIOR ART FIG. 1
FIG. 1 is a diagram of a prior art dual duct HVAC system.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The invention is shown in FIGS. 1 through 4. FIG. 1 shows a prior art HVAC system of a type which utilizes a dual duct system. In this system, there is a first conditioned air source 12, which could supply either hot or cold air. For this example, 12 will be designated as a cold air source. The prior art system in FIG. 1 also includes a second conditioned air source 14, which in this example will be designated as a hot air source. The cold air source 12 feeds into a first main duct system 16. The first main duct system 16 extends to each of the heating and cooling zones 36 and delivers cold air to a heating and cooling zone damper 38. The cool air from the cool air source 12 is delivered at essentially the same temperature to each of the heating and cooling zone dampers 38 of each heating and cooling zone 36. Similarly, air from the hot air source 14 passes through the second main duct system 18, with one duct of hot air being delivered to each heating and cooling zone damper 38. Each heating and cooling zone damper 38 can include a mixing chamber 40. According to the heating and cooling needs of each room, or heating and cooling zone 36, the pair of dampers 38 in each room opens and closes proportionately to deliver the calculated amount of hot air and cool air to satisfy the room's air volume requirements as well as air temperature requirements. There would typically be a mixing chamber 40 in which the air supplies of two different temperatures would be mixed together before it would be allowed to enter the room through a diffuser 42. Interior zones 44 would be heated or cooled in a similar manner. Air returns 34 bring air back to the first and second main duct systems 16 and 18.

Figure 2:
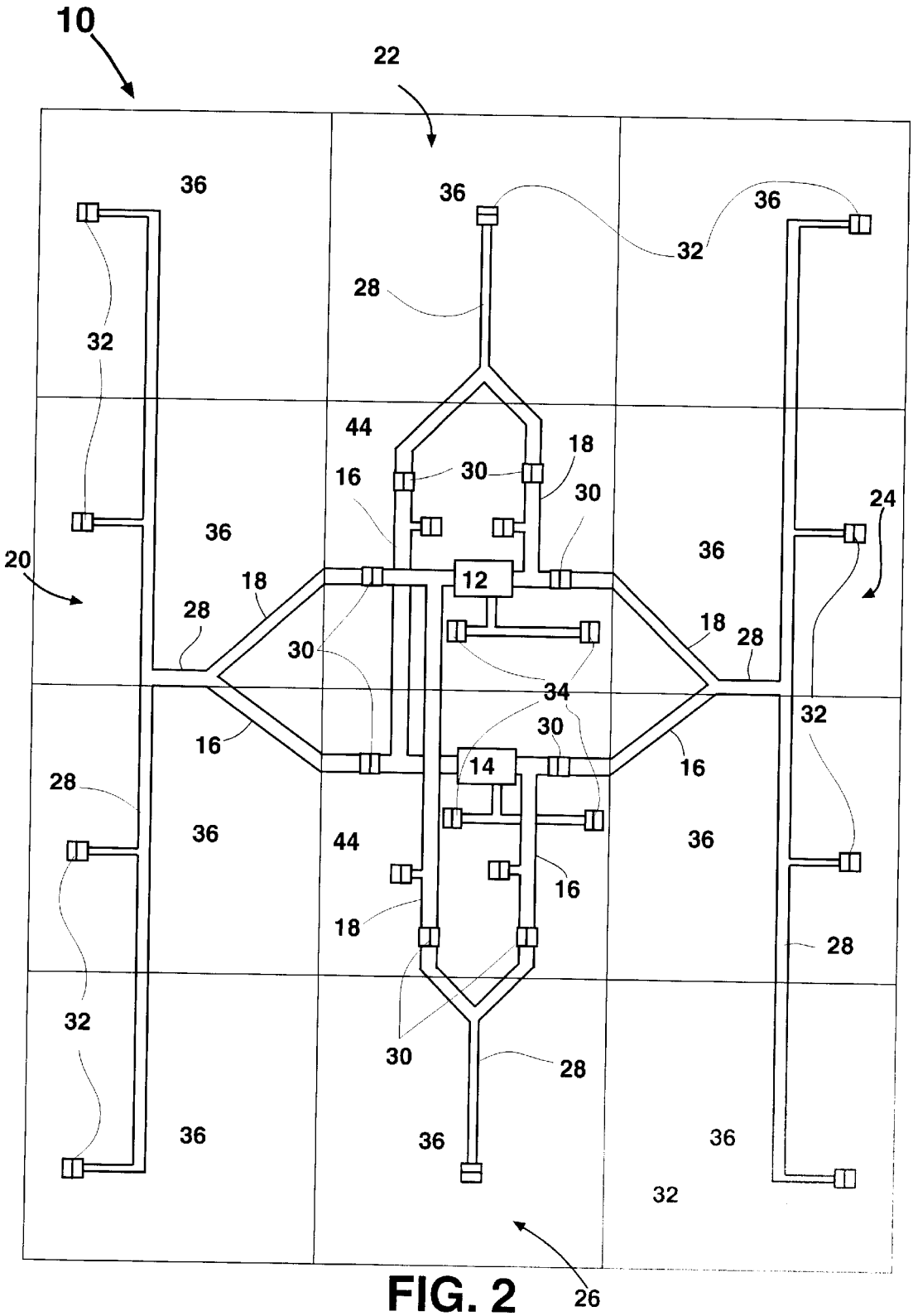
FIG. 2 is a diagram of the HVAC system of the invention.

FIG. 2 shows an HVAC system laid out according to the present invention. It includes portions of the building designated as a first exterior exposure 20, and second, third and fourth exterior exposures 22, 24 and 26. Each of the exterior exposures includes a number of rooms, or heating and cooling zones 36. Additionally, there are interior heating and cooling zones 44. Within each heating and cooling zone 36 is located a heating and cooling zone damper 32. Each heating and cooling zone damper 32 is attached to a distribution duct system 28. Each distribution duct system 28 is attached to a first main duct system 16 and a second main duct system 18. Branch lines of the main duct systems extend toward each of the exterior exposures, and end in an exterior exposure damper 30. The exterior exposure damper 30 in each of the first and second main duct systems opens and closes to regulate the volume of air from each of the two main duct systems which enters the distribution duct system 28.

The first conditioned air source 12 and the second conditioned air source 14 are configured to supply different temperatures of air. In one embodiment of the invention, one would supply hot air, and one would supply cold air. However, in another preferred embodiment of the invention, one or both of these conditioned air sources can supply either hot or cold air depending on the situation. Thus, if it were a very hot day, both the first conditioned air source 12 and the second conditioned air source 14 could be switched to both provide cold air into the first main duct system 16 and the second main duct system 18. Similarly, on an exceptionally cold day, both the first conditioned air source 12 and second conditioned air source 14 could be switched to both provide hot air. Air returns 34 bring air back to the first and second main duct systems 16 and 18.

In this configuration, the invention can be modified so that one pair of air sources 12 and 14 supply the heating and cooling needs for one floor of a building. The system could be modified so that one pair of conditioned air sources 12 and 14 also supply multiple floors of a building, or an entire building. In the case of multiple floors or an entire building, the conditioned air sources 12 and 14 would be correspondingly larger, and the VAV control system would be correspondingly more complicated, so that each heating and cooling zone 36 received the air temperature and volume that it required.

It is obvious that this system could take many configurations, depending on the number of square feet of the building, and the number of heating and cooling zones 36.

Figure 3:
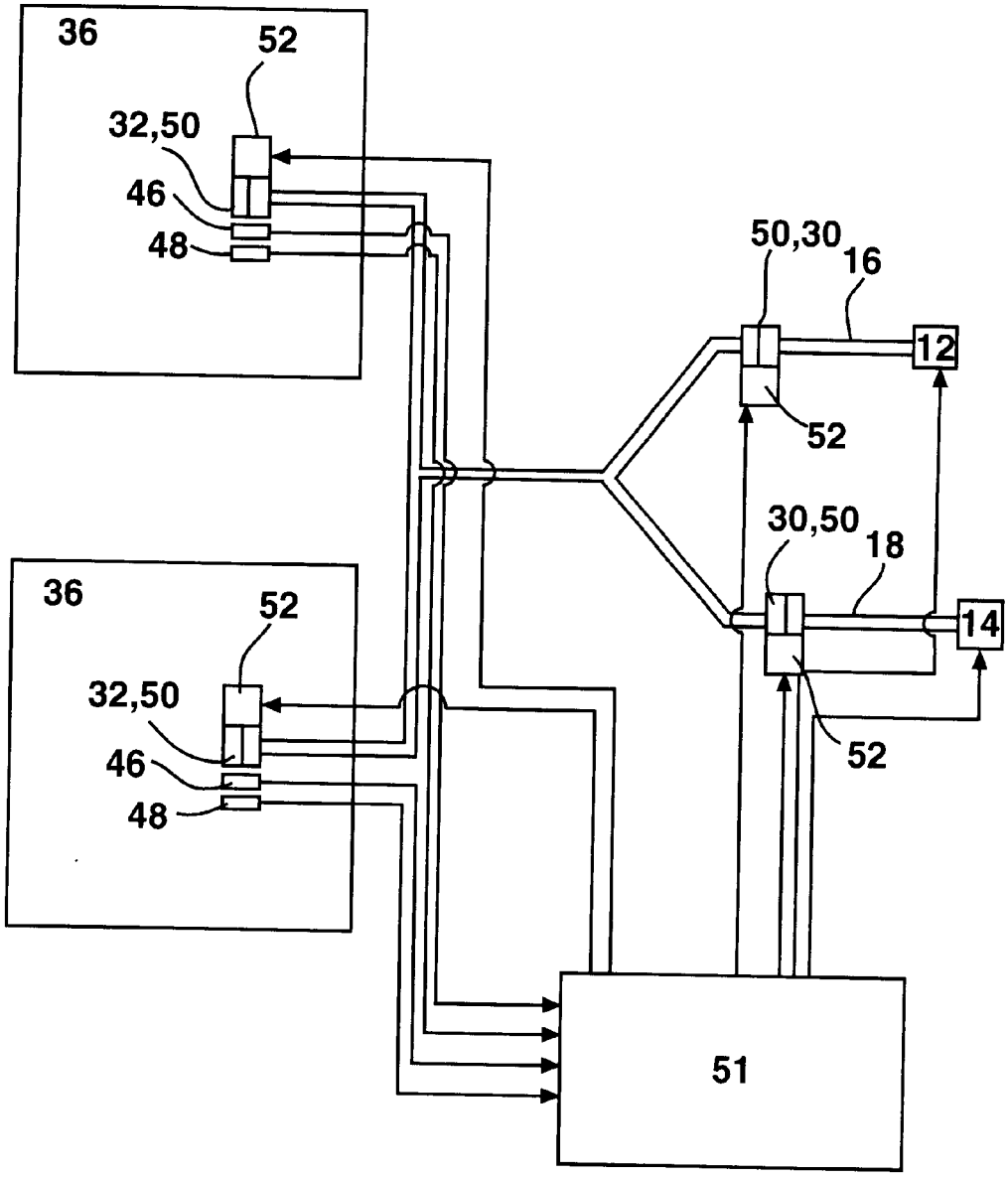
FIG. 3 is a diagram of the control system of this invention.

FIG. 3 shows the use of the computing device in relation to controlling the air temperature and volume to each room. A room temperature sensor 46 is located in the heating and cooling zone 36. An airflow sensor 48 is located in each heating and cooling zone 36 adjacent to each heating and cooling zone damper 32. Information from the air temperature sensor 46 and the airflow sensor 48 are processed in the computing devices 50 and 51, and a signal is sent out to the damper motors 52 which adjusts the heating and cooling zone dampers 32 and the exterior exposure dampers 30. A control signal is also sent out to the first conditioned air source 12 and the second conditioned air source 14, which adjusts the temperature output of these devices.

Figure 4:
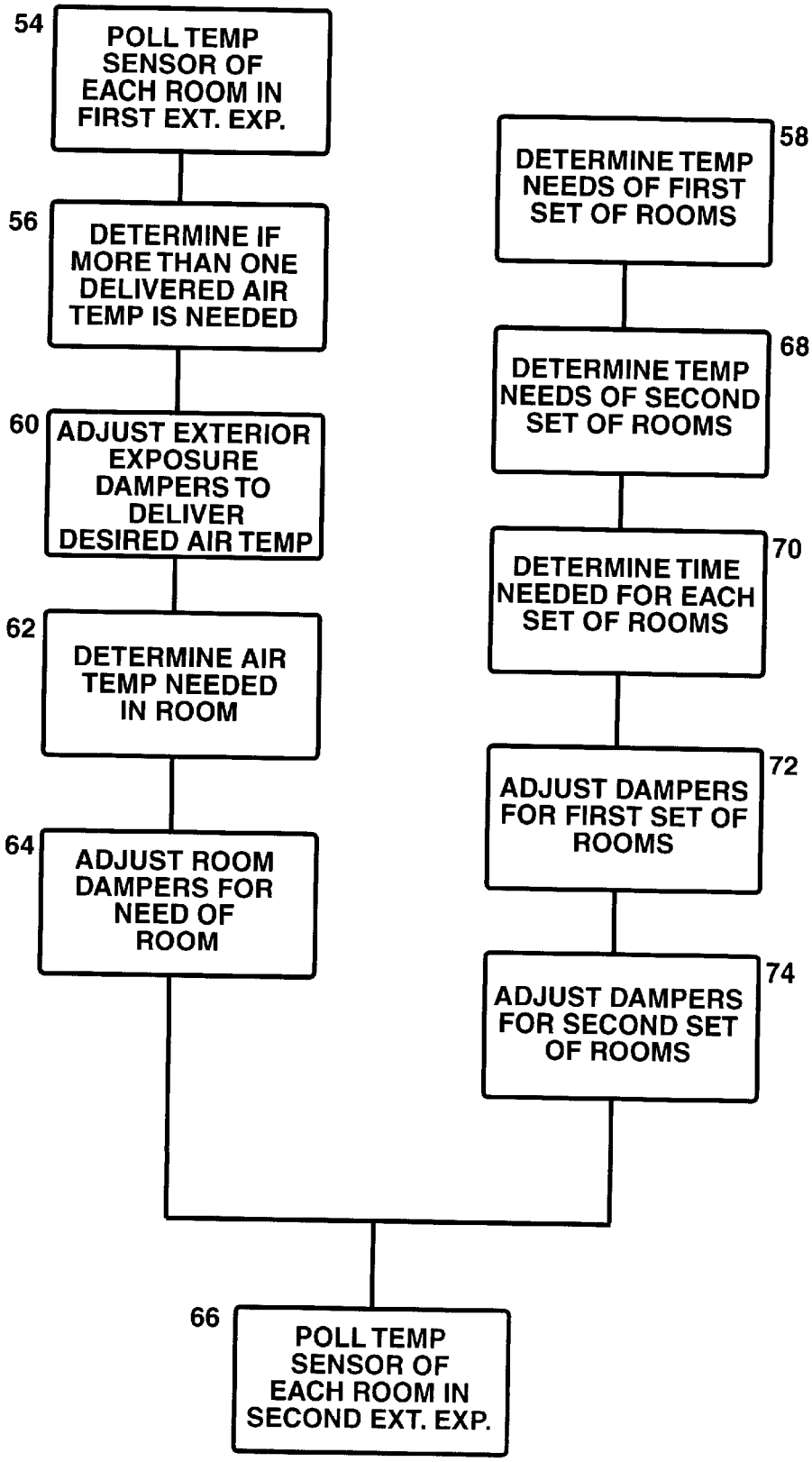
FIG. 4 is a logic diagram of the invention.

FIG. 4 is a logic diagram which illustrates a portion of the VAV logic which is utilized in the computing devices 50 and 51 for controlling the operation of air delivery in the system. In box 54, the temperature sensors in each room (heating and cooling zone) 36 are polled, for the first exterior exposure. At box 56, it is determined whether one temperature of air will supply the needs of each of the rooms in the first exterior exposure, or if more than one temperature of air needs to be delivered to that exterior exposure. If more than one temperature of air will be required, the logic flows to box 58. If only one temperature of air will be required for the first exterior exposure, then the logic proceeds to box 60. At box 60, the exterior exposure dampers for that particular first exterior exposure are adjusted to deliver the desired air temperature. At box 62, the air temperature needs of each room are determined, and at box 64, the heating and cooling zone dampers 32 in each room are adjusted to deliver the proper amount of air at the selected temperature into each room. After the logic step of 64, the next cycle starts which polls the temperature sensors of each room in the second exterior exposure.

If more than one temperature of air is required to heat the rooms of the first exterior exposure, after determining the temperature needs of the first set of rooms in 58, the temperature needs of the second set of rooms is determined at box 68. Then, the amount of time needed for each set of rooms to receive their selected temperature of air is determined at step 70. At step 72, both the exterior exposure dampers 30 and the heating and cooling zone dampers 32 are adjusted to deliver first the temperature of air to the first set of rooms and then the temperature of air to the second set of rooms for the selected time period.

This general logic flow can be applied to a large number of exterior exposure zones and heating and cooling zones 36. The same logic sequence would be applied for determining the required volume of airflow in each of the heating and cooling zones 36. Similar control logic, although with more layers and steps, would also be utilized for an HVAC application in which one computing device 51 and one first conditioned air source 12 and one second conditioned air source 14 would be utilized in a multi-floor building. This type of logic would also control the situation in which the two conditioned air sources 12 and 14 would be switchable so that both could supply cold air at the same time and both would supply warm air at the same time.

The heating and cooling of interior zones 44 would also be handled through similar logic as for exterior exposures.

While there is shown and described the present preferred embodiment of the invention, it is to be distinctly understood that this invention is not limited thereto but may be variously embodied to practice within the scope of the following claims.

From the foregoing description, it will be apparent that various changes may be made without departing from the spirit and scope of the invention as defined by the following claims.

I claim:

1. An HVAC system for providing heating and cooling in a building with multiple exterior exposures and heating and cooling zones, which comprises:

a first conditioned air source, for providing cold air with a selected temperature to said HVAC system;

a second conditioned air source, for providing conditioned air to said HVAC system, in which said second conditioned air source has the capability of supplying hot or cold air;

a first main duct system which includes a plurality of first main ducts, with at least one first main duct for each exterior exposure, with each first main duct connected to said first conditioned air source and terminated at a distal end;

a second main duct system which includes a plurality of second main ducts, with at least one second main duct for each exterior exposure, with each second main duct connected to said second conditioned air source and terminated at a distal end;

a plurality of exposure dampers installed in said distal ends of said first and second main ducts of said first and said second main duct systems, which variably open or close upon command, to allow a selected flow of conditioned air to pass through said exposure dampers;

a distribution duct system which is attached to said distal ends of said ducts of said first and said second main duct system, and which extend as a single duct to a plurality of zone dampers with zone diffusers;

a plurality of temperature sensors positioned in said heating and cooling zones, with at least one temperature sensor positioned in each heating and cooling zone, for sensing a measured temperature of air in said heating and cooling zones;

a plurality of air flow sensors positioned adjacent to said zone dampers in said heating and cooling zones, with at least one air flow sensor positioned in each heating and cooling zone, for sensing a measured airflow through a zone damper and into a heating and cooling zone;

a plurality of temperature set point selectors, with at least one temperature set point selector positioned in each heating and cooling zone, which are settable by a user to a desired temperature in a heating and cooling zone;

a plurality of airflow set point selectors, with at least one airflow set point selector positioned in each heating and cooling zone, which are settable by a user to a desired airflow in a heating and cooling zone;

return air intakes and return air ducts, for returning air from said heating and cooling zones to said first and said second conditioned air sources; and a computer which for each heating and cooling zone, compares said desired temperature with said measured temperature, and determines by vote of said heating and cooling zones in a particular exterior exposure a temperature of air to be sent to each of said exterior exposures, and which for each heating and cooling zone, compares said desired air flow with said measured airflow, and determines an airflow for each heating and cooling zone, and adjusts said exposure dampers and said zone dampers to deliver heated or cooled air to said zone to achieve said desired temperature and said desired airflow in each said heating and cooling zone.

2. The HVAC system for providing heating and cooling in a building with multiple exterior exposures and heating and cooling zones of claim 1, which further includes at least one interior zone damper from said first conditioned air source, for supplying heated or cooled air to an interior space.

3. The HVAC system for providing heating and cooling in a building with multiple exterior exposures and heating and cooling zones of claim 2, which further includes at least one interior zone damper from said second conditioned air source, for supplying conditioned air to said interior space.

4. The HVAC system for providing heating and cooling in a building with multiple exterior exposures and heating and cooling zones of claim 1, in which said first conditioned air source supplies cool air, and said second conditioned air source supplies either cool or warm air.

5. The HVAC system for providing heating and cooling in a building with multiple exterior exposures and heating and cooling zones of claim 4, in which said both said first conditioned air source and said second conditioned air source can supply either cool air or hot air, as directed by said computer.

6. The HVAC system for providing heating and cooling in a building with multiple exterior exposures and heating and cooling zones of claim 1, in which said first conditioned air source can be configured to supply either cool air or ventilation air, and said second conditioned air source can be configured to supply either cool, warm, or ventilation air.

7. The HVAC system for providing heating and cooling in a building with multiple exterior exposures and heating and cooling zones of claim 1, in which said computer responds to conflicting air temperature needs of heating and cooling zones within a particular exterior exposure by sending one temperature of air to certain heating and cooling zones for a period of time, and then sending air of another temperature to other heating and cooling zones for a period of time.

8. The HVAC system for providing heating and cooling in a building with multiple exterior exposures and heating and cooling zones of claim 4, in which said cool air supplied by said first conditioned air source is from 40 to 55 degrees F.

9. The HVAC system for providing heating and cooling in a building with multiple exterior exposures and heating and cooling zones of claim 1, in which said first and second main ducts are from 4 inches to over 120 inches in diameter.

10. The HVAC system for providing heating and cooling in a building with multiple exterior exposures and heating and cooling zones of claim 1, in which said distribution ducts are from 4 inches to over 120 inches in diameter.

11. The HVAC system of claim 1 in which one first conditioned air source and one second conditioned air source are configured to provide temperature and airflow control to a plurality of floors of a building.

* * * * *